US006170559B1

(12) United States Patent
Barge

(10) Patent No.: US 6,170,559 B1
(45) Date of Patent: Jan. 9, 2001

(54) APPARATUS FOR CASTING A LEAD FORMATION ON BATTERY PLATE LUGS

(75) Inventor: Christopher Stephen Barge, Bristol (GB)

(73) Assignee: TBS Engineering Limited, Cheltenham (GB)

( * ) Notice: Under 35 U.S.C. 154(b), the term of this patent shall be extended for 0 days.

(21) Appl. No.: 09/214,280

(22) PCT Filed: Jul. 6, 1998

(86) PCT No.: PCT/GB98/02008

§ 371 Date: Feb. 10, 1999

§ 102(e) Date: Feb. 10, 1999

(87) PCT Pub. No.: WO99/04919

PCT Pub. Date: Feb. 4, 1999

(30) Foreign Application Priority Data

Jul. 23, 1997 (GB) ..... 9715383

(51) Int. Cl.[7] ..... B22D 27/04; B22D 19/04

(52) U.S. Cl. ..... 164/338.1; 164/332; 164/334

(58) Field of Search ..... 164/121, 332, 164/80, 102, 103, 109, 112, 130, 326, 334, 338.1, DIG. 1

(56) References Cited

U.S. PATENT DOCUMENTS

| | | | | |
|---|---|---|---|---|
| 3,395,748 | | 8/1968 | Tiegel | 164/109 |
| 4,425,959 | * | 1/1984 | Mund | 164/338.1 |
| 4,534,401 | * | 8/1985 | Schaumburg et al. | 164/338.1 |
| 5,520,238 | * | 5/1996 | Hopwood | 164/337 |

FOREIGN PATENT DOCUMENTS

| | | |
|---|---|---|
| 24 27 639 | 7/1975 | (DE) . |
| 2 023 471 | 1/1980 | (GB) . |
| WO 94/16466 | 7/1994 | (WO) . |

* cited by examiner

*Primary Examiner*—Harold Pyon
*Assistant Examiner*—I.-H. Lin
(74) *Attorney, Agent, or Firm*—Young & Thompson

(57) ABSTRACT

There is disclosed an apparatus for casting a lead formation, particularly on the lug of a battery component. The lead is streamed over a mould block (20) defining a mould cavity (21) to flood the cavity (21). The flow of lead is maintained to raise the temperature of the block (20), at least adjacent the cavity, to achieve an appropriate working temperature.

5 Claims, 2 Drawing Sheets

APPARATUS FOR CASTING A LEAD FORMATION ON BATTERY PLATE LUGS

CROSS REFERENCE TO RELATED APPLICATION

This is the 35 USC §371 National Stage of International application PCT/GB98/02008 filed on Jul. 6, 1998, which designated the United States of America.

FIELD OF THE INVENTION

This invention relates to methods and apparatus of casting a lead formation on the lug of a battery component For the purposes of this Specification the term "lead" includes suitable lead alloys.

BACKGROUND OF THE INVENTION

It is well known to cast straps and other formations on the lugs of battery plates, for example to connect together each of the plates in a group. In almost all cases this is done by filling a mould cavity with lead and dipping the lugs into that cavity. In order for an acceptable connection to be made between the lead and the lug, the temperature of the lead at the interface needs to be above the freezing point of lead. In general this requires the lead block to be heated by a heat source, such as a gas flame, until the lugs are dipped into a cavity and then cooling has to occur so that the lead solidifies quickly. Most such heating arrangements are inefficient and expensive. Attempts have been made to dip the mould block into a pot of molten lead in order to achieve the desired result, but this precludes the use of ejector means for removing the cast on straps from the mould, because the lead would clog up and such moveable parts.

The more normal method of filling the mould cavities is to flow lead in channels to the side of the cavities and allow it to spill over weirs. This can require very great control of lead flow, if one is to ensure that the cavities are filled but the mould as a whole is not over filled.

SUMMARY OF THE INVENTION

From one aspect the invention consists in a method of casting a lead formation on the lug of a battery component, comprising streaming lead over a mould block defining a mould cavity to flood the cavity and maintaining the flow of the lead until the temperature of the mould block, at least adjacent the cavity, is raised by heat from the lead until an appropriate working temperature is reached.

This streaming of the lead over the mould block not only provides for very good filling of the cavity but also very efficient heating of the mould block, because there is good conduction between the molten lead and the mould block. Further as the lead moves over the mould block, rather than the mould block into the lead, mechanical parts such as an ejector system can be provided in a position which is permanently away from the lead stream.

In a particularly preferred arrangement, the heat from the molten lead provides substantially the only heat source for the mould, thus obviating the need for additional heaters.

The appropriate working temperature is that at which lugs can successfully be connected to the castings. It will usually be equal to or exceed the freezing temperature of the lead, but experiments have shown that in certain mould configurations at least slightly lower temperatures are operative.

An important feature of this method is that, where the mould temperature is above the freezing point of the lead, it acts as a positive heat reservoir acting to maintain the lead temperature if the lugs should take out too much heat from the molten lead in the cavity. This is particularly useful where the volume of the mould cavity, and thus the thermal energy of the lead, is low relative to the thermal capacity of the lugs. In other words, the method allows a positive net flow of heat from the mould to the lead in the cavity if the temperature of the molten lead drops.

The method may further include dipping the lugs into the cavity immediately after the stream has stopped, although preferably excess lead is scraped from around the top of the cavity prior to dipping.

The block may be cooled to cast the lead, in the cavity on to the lug and usually there would be a plurality of cavities and/or lugs.

From another aspect there is provided apparatus for casting a lead formation comprising a source of molten lead, a mould block having a mould cavity in an upper face thereof, retaining means for defining a lead pond over the upper face of the block, an inlet at one end of the pond and an outlet at the other, whereby lead can be streamed through the pond to flood the cavity and raise the temperature of the block, means for maintaining the flow of lead at least until the block is at the freezing temperature of lead and means for halting the flow of lead when the desired block temperature is reached.

Preferably the outlet is below the level of the upper surface (eg. in the manner of a weir) so that the lead drains off the upper surface. The apparatus may further include scraper means for removing excess lead from the upper surface and/or ejector means for ejecting a cast component from the cavity of cavities.

The apparatus may still further include means for lowering a battery plate group to dip the lugs of the group into the cavity. There may be multiple groups and multiple cavities.

Clamping means may be provided for laterally retaining the mould block.

Although the invention has been defined above it is to be understood it includes any inventive combination of the features set out above or in the following description.

BRIEF DESCRIPTION OF THE DRAWINGS

The invention may be performed in various ways and a specific example will now be disclosed, by way of example, with reference to the accompanying drawings in which.

DETAILED DESCRIPTION OF THE INVENTION

Figure 1:
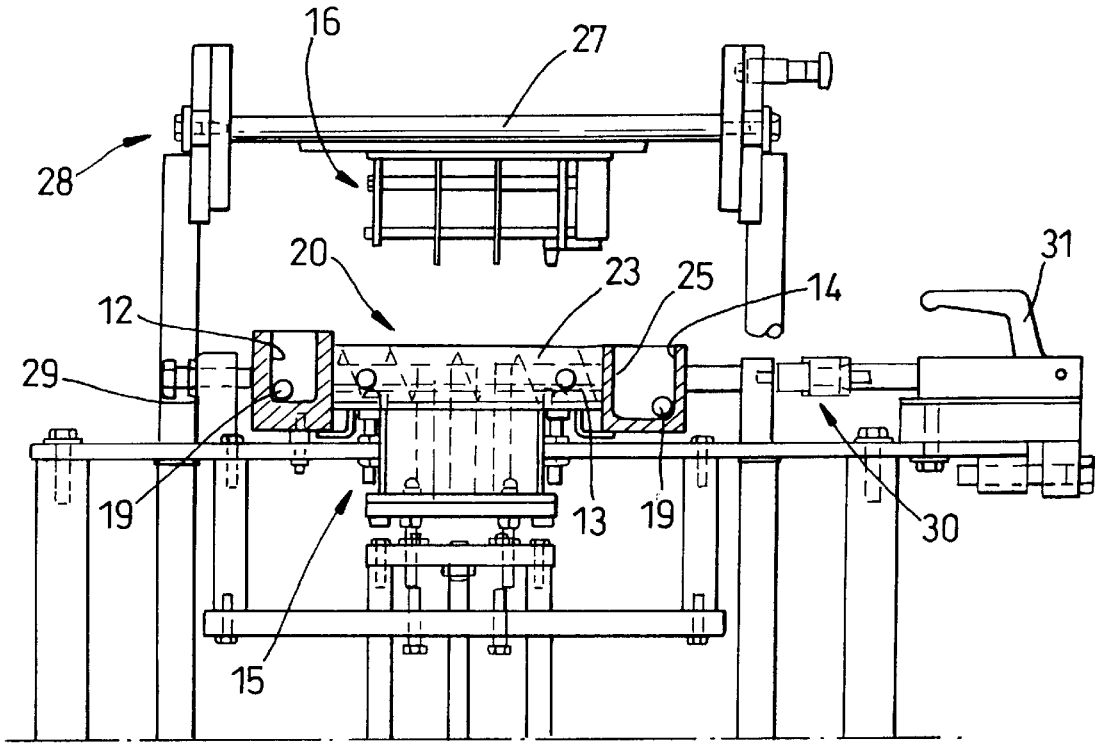
FIG. 1 is a side view of apparatus for casting a lead formation, with part of the apparatus shown in section.
Figure 2:
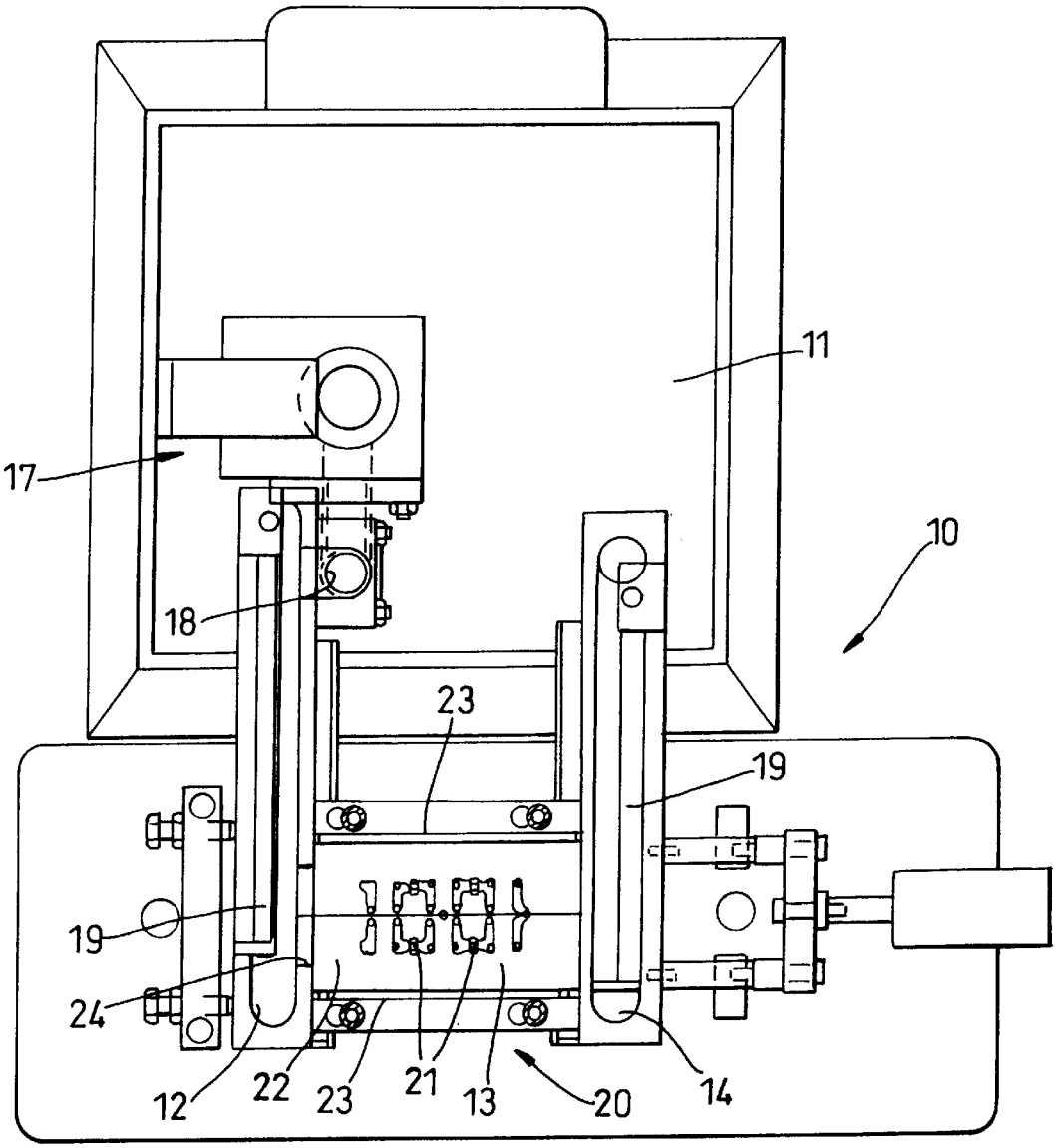
FIG. 2 is a view of that apparatus from above with the jig box removed.

Lead casting apparatus is generally indicated at 10 and comprises a lead pot 11, an inlet canal 12, a mould 13, and outlet canal 14, an ejector mechanism 15 and a movable jig box 16. The lead pot 11 could conveniently be moved adjacent to the left hand side of the mould 13, for example, instead of being in the orientation shown in FIG. 2.

The lead pot 11 is provided with a pump mechanism, generally indicated at 17 that includes an archimedes screw (not shown), which raises molten lead up into the inlet canal 12 via an outlet 18. The inlet outlet canals 12, 14 are provided with heating elements 19.

Turning to the mould 13, it comprises a mould block 20, which has mould cavities 21 cut into its upper face 22. Walls 23 extend along the sides of the block 20 to form a pond. The inlet canal 12 has an outlet 24, upstream of the pond, whilst there is an outlet 25 (in a form of a weir) to the outlet canal 14. The outlet canal 14 returns to the lead pot where it has a return outlet 26 for lead to flow back into the pot. The inlet canal 12 and outlet canal 14 can be positioned against the mould in any suitable way. For example, compressed springs may be used. Alternatively the inlet canal 12 could be bolted to the mould 13 and outlet canal 14 could merely rest against it.

The battery plate jig box 16 is suspended over the mould block 20 on a bar 27, which is in turn supported on a mechanism 28 that can raise and lower the jig box to allow the lugs of battery plates supported in the jig box 16 to be dipped into the mould cavities 21 and then raised therefrom.

In order to allow for quick release of the mould block, the inlet canal 12 is laterally restrained by an abutment 29 and the mould block in turn lies against the inner face of the inlet canal 12. The outlet canal 14 is in turn abutted against the mould block 20 and is urged into that position by a releasable spring loaded mechanism generally indicated at 30. When the mechanism is released by its handle 31 the outlet canal can be moved to the right and the mould block readily replaced.

In use the pump 17 is switched on and lead at a temperature typically of about 450° C. flows along the inlet canal 12 through the pond and back, via the outlet canal 14, to the pump. The mould cavities 21 are flooded and the stream of lead is maintained until the mould block has reached a desired temperature, which is usually at least the freezing temperature of lead, but may be just below, and typically about 310° C. This temperature can be detected by a thermistor or other temperature measuring device, or the system can simply be run for a specific time period, which can either be calculated or derived empirically.

Once the mould block temperature is achieved, the pump 17 is switched off and the lead flows out of the pond into the outlet canal 14 leaving a substantially lead free surface. A scraper mechanism may be provided to scrape the upper face 22 of the mould block 20 to ensure that only lead in the cavities 21 is retained. The jig box 16 is then immediately lowered by the mechanism 29 and the formations defined by the cavities 21 are moulded onto the lugs of the battery plates. Finally the ejector mechanism 15 is operated to release the lead mouldings from the cavities 22 as the jig box 16 is returned to its raised position and the battery plates can then be removed from it.

It will be understood that the above apparatus is particularly suitable for such batteries as motor cycle batteries, where the straps or formations are of small size and hence it is particularly difficult to ensure that the lead is kept hot enough in the cavities for long enough for the lugs to be dipped into them. However, the arrangement described is equally applicable to moulds and mould cavities of a variety of sizes. It will be noted that one advantage of the system is that there are no moving parts in the mould, which interact with molten lead, other than the scraper. Further the ejector mechanism is kept entirely clear from the lead stream.

What is claimed is:

1. Apparatus for casting a lead formation comprising a source of molten lead, a mould block having a mould cavity in an upper face thereof, retaining means for defining a lead pond over the upper face of the block, an inlet at one end of the pond and an outlet at the other end of the pond, whereby lead can be streamed through the pond to flood the cavity and raise the temperature of the block, means for maintaining a flow of lead at least until the block is at an appropriate working temperature and means for halting the flow of lead when the desired block temperature is reached.

2. Apparatus as claimed in claim 1 herein the outlet is below the level of the upper face, so that the lead drains off the upper face.

3. Apparatus as claimed in claim 1 further including scraper means for removing excess lead from the upper face.

4. Apparatus as claimed in claim 1 further including ejector means for ejecting a cast component from the cavity.

5. Apparatus as claimed in claim 1 further including means for lowering a battery plate group to dip the lugs of the group into the cavity.

* * * * *